US005558159A

United States Patent [19]

Kato

[11] Patent Number: 5,558,159

[45] Date of Patent: Sep. 24, 1996

[54] HEADER TANK STRUCTURE FOR HEAT EXCHANGER

[75] Inventor: Soichi Kato, Osato-gun, Japan

[73] Assignee: Zexel Corporation, Tokyo, Japan

[21] Appl. No.: 343,864

[22] Filed: Nov. 17, 1994

[30] Foreign Application Priority Data

Nov. 24, 1993 [JP] Japan ..... 5-062834 U
Nov. 8, 1994 [JP] Japan ..... 6-273505

[51] Int. Cl.[6] ..... F28F 9/00

[52] U.S. Cl. ..... 165/153; 165/173; 29/890.052; 29/890.053; 138/171

[58] Field of Search ..... 165/153, 173, 165/175; 29/890.052, 890.053; 138/171

[56] References Cited

U.S. PATENT DOCUMENTS 3,746,050 7/1973 Born et al. ..... 138/171 X
4,945,635 8/1990 Nobusue et al. ..... 29/890.052 X
5,243,842 9/1993 Kobayashi et al. ..... 29/890.052 X
5,348,213 9/1994 Randlett et al. ..... 29/890.053 X

*Primary Examiner*—Leonard R. Leo
*Attorney, Agent, or Firm*—Kanesaka & Takeuchi

[57] ABSTRACT

The invention relates to a header tank structure for a heat exchanger formed by rounding a clad material (a header tank material) into a circular tube form, and the header tank structure eliminates occurrence of swollen portions around the connecting portion of the ends of the header tank, and displacement of the connecting surfaces from each other is reduced, thereby to provide the header tank structure having an improved quality of brazing the connecting surfaces of the ends.

The invention is, in a header tank structure for a heat exchanger formed by rounding a header tank material to bring the ends thereof into butting with each other and connecting them together by brazing, the header tank material having either one of the surfaces which becomes the outer surface of the header tank or both surfaces which become outer and inner surfaces of the header tank are being coated with a brazing material, and the ends of the header tank material are formed with inclined surfaces which are respectively inclined with respect to a direction of wall thickness, each with a portion of end edge surface being left there.

6 Claims, 8 Drawing Sheets

HEADER TANK STRUCTURE FOR HEAT EXCHANGER

PRIOR ART

Conventional heat exchanger, for example, a parallel flow type heat exchanger, comprises a plurality of tubes and fins which are alternately stacked one upon another, and the ends of each of the stacked tubes are inserted into insertion holes provided in the header tank and connected therewith.

Conventionally, the header tank of circular tube formed by rounding a clad material by roll forming and connect the ends thereof is known (for example, as disclosed in Japanese Utility Model Laid-Open Publication No. 2(1990)-48268 and Japanese Patent Laid-Open Publication No. 4(1992)-220129).

As shown in FIGS. 10 and 11, this type of header tank 21 uses, as a header tank material, a double-faced clad material 23 having both surfaces coated with a brazing material 22, and is formed by rounding the double-faced clad material 23 into a circular form by roll forming, and butting surfaces 24, 24 of the ends are connected together by brazing.

Further, the butting surfaces 24, 24 of the double-faced clad material 23 for forming the header tank 21 are inclined with respect to the direction of wall thickness. In other words, the butting surfaces 24, 24 of the ends of the double-faced clad material are so formed that the surface of one end is gradually thinned from the outer surface towards the inner surface with respect to the direction of wall thickness and the surface of other end is gradually thinned from the inner surface towards the outer surface.

Then, such inclined butting surfaces 24, 24 are formed to have the brazing material 22 remained thereon. Thereafter, the double-faced clad material 23 is rounded into the circular tube by roll forming, and the inclined butting surfaces 24, 24 of the ends are connected by brazing to form the header tank 21. In these FIGURES, numeral 26 designates a flat tube, and 27 designates a tube insertion hole.

However, the above-described conventional header tank of heat exchanger has such disadvantages that when forming the inclined butting surfaces by press forming, the material of the wall at the end portion, which was crushed during pressing, tends to escape into other portions, and It causes swollen portions 28 around the wall of the inclined butting surfaces, as shown in FIG. 12, or waves are formed in the inclined butting surfaces. Further, during assembly of the header tank, the butting surfaces are displaced from each other even when the inclined butting surfaces are held down in a radial direction of the header tank to have them butting properly.

When the wall around the butting surfaces is swollen or the butting surfaces are displaced from each other, it is inconvenient to attach an additional member, for example, a bracket, to the header tank, because it needs to chop off such swollen portions or protruding portions caused by displacement. Thus, it requires such an additional and separate processing step of chopping off, which causes an increase of manufacturing cost.

A further problem is that when the inclined butting surfaces are waving, there will be gaps between connecting surfaces which results in lowering the quality of brazing the connecting surfaces.

The present invention provides an improved header tank structure for heat exchanger which does not cause swollen portions around the butting surfaces and minimizes occurrence of displacement of the butting surfaces from each other during assembly, and consequently, the quality of brazing the connecting surfaces is improved.

DISCLOSURE OF THE INVENTION

In order to achieve the above-described objects, a first aspect of this invention is that in a header tank structure for heat exchanger formed by rounding a header tank material to bring the ends thereof into butting with each other and connecting them together by brazing, the header tank material having one of surfaces to become the outer surface of the header tank being coated with a brazing material, the surface of each of the ends of the header tank material is inclined with respect to a direction of wall thickness, with a portion of end edge surface being left there.

With the above-described header tank structure for heat exchanger according to the first aspect of the invention, a first preferred embodiment is that the inclined surfaces of the ends are so formed that the surface of one end is gradually thinned from the outer surface towards the inner surface with respect to the wall thickness with the portion of end edge surface being left there, and the surface of the other end is gradually thinned from the inner surface towards the outer surface with respect to the direction of wall thickness with the portion of end edge surface being left there. When the two inclined surfaces are brought into pressure contact with each other, a recess is formed respectively in both outer surface and inner surface of the header tank by the portion of the end edge surface being left there and the inclined surface.

A second preferred embodiment of the header tank structure for heat exchanger of the first aspect of the invention is that the inclined surfaces formed at the ends of the header tank material are both gradually thinned from the outer surface towards the inner surface with respect to the wall thickness, each surface with the portion of end edge surface being left there. When the portions of the end edge surface left are brought into pressure contact with each other, a recess is formed in the outer surface of the header tank by the two inclined surfaces.

A second aspect of the invention is that in a header tank structure for heat exchanger formed by rounding a header tank material to bring the ends thereof into butting with each other and connecting them together by brazing, the header tank material having both surfaces which become the outer surface and the inner surface of the header tank being coated with a brazing material, and each end has an inclined surface with respect to the direction of wall thickness with a portion of the end edge surface being left there.

A first preferred embodiment of the header tank structure for heat exchanger according to the second aspect of the invention is that the inclined surfaces at the ends of the header tank material are so formed that the surface of one end is gradually thinned from the outer surface towards the inner surface with respect to the direction of wall thickness and the surface of the other end is thinned from the outer surface towards the inner surface with respect to the direction of wall thickness, each with a portion of end edge surface being left there. When the inclined surfaces are brought into pressure contact with each other, a recess is formed in both outer surface and inner surface of the header tank by the portion of end edge surface being left there and the inclined surface.

A second preferred embodiment of the header tank structure for heat exchanger of the second aspect of the invention is that the inclined surfaces at the ends of the header tank material are so formed that the surface of one end is gradually thinned from the outer surface towards the inner surface with respect to the direction of wall thickness with the center portion of end edge surface being left, and the surface of the other end is thinned in a reverse direction with the center portion of end edge surface being left, so that the center portions of the end edge surfaces being left interpose between the two surfaces. When the center portions of the end edge surfaces of both ends are brought into pressure contact with each other, a recess is formed in the outer surface and the inner surface of the header tank by the inclined surfaces.

According to the header tank structure of the present invention, the clad material, that is, the header tank material, is rounded by roll forming or press forming, and the ends of header tank material are butted to each other and connected together by brazing.

With the header tank structure of the present invention, each end of the header tank material is formed with an inclined surface with respect to the direction of wall thickness with a portion of end edge surface being left there. Thus, only a portion of the end, not the entire end, is subjected to press forming. This minimizes the portion of material tending to escape to other portions as a result of being crushed during press forming, thereby a possible deformation of the ends caused by press forming is kept to as little as possible. In this respect, in the prior art header tank, the entire portions of the ends are pressed during press forming, and the surfaces of the ends are thinned either from the outer surface towards the inner surface with respect to the direction of wall thickness or from the inner surface towards the outer surface with respect to the direction of wall thickness. In other words, with the prior art header tank, the inclined surface is formed uniformly over the entire surface of each end of the header tank material. Consequently, during the oblique pressing process, the ends of the material are always displaced laterally, and, as a result, dimensions of the portions to be in pressure contact cannot be uniform. The present invention is improved in this respect.

With the present invention as described above and where the inclined surfaces serve as the connecting surfaces, swollen portions are not formed on the inclined surfaces, and a V-shaped recess is formed at the connecting portion when the two connecting surfaces are butted with each other, thereby the brazing material is pulled into the V-shaped recess during brazing process. This assures the quality of brazing the connecting surfaces and provides a good brazing effect.

Further, with the present invention which forms the surfaces of the ends of the header tank material being inclined with respect to the direction of wall thickness, each with a portion of end edge surface being left there, the portions of end edge surfaces left are brought into pressure contact with each other, since the end edge surfaces are transversely to the direction of wall thickness, thereby to assure the pressure contact of the end edge surfaces. In this case, too, the V-shaped recess is formed, so that the brazing material is pulled into the V-shaped recess during the brazing process as same as the above-described aspect of the invention, thereby to assure the quality of brazing the connecting surfaces and to provide a good brazing effect.

DETAILED DESCRIPTION OF THE PREFERRED EMBODIMENTS

Now a first embodiment of the present invention will be described by referring to the accompanying drawings. With this embodiment, the heat exchanger incorporating the header tank of this invention is a parallel flow type heat exchanger.

Figure 1:
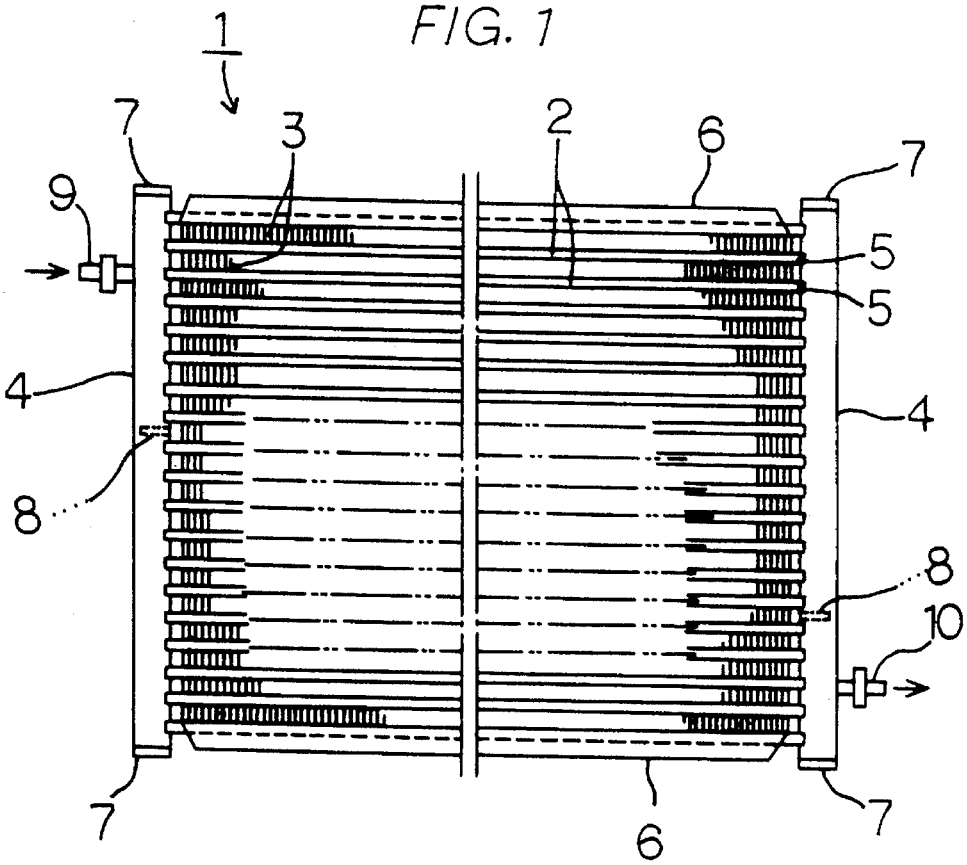
FIG. 1 is a front view of a heat exchanger showing an embodiment of the present invention.

Referring to FIG. 1, a heat exchanger 1 of this embodiment comprises a plurality of flat tubes 2 and corrugated fins 3 which are alternately stacked one upon another, and the ends of the stacked flat tubes 2, 2 are respectively inserted into insertion holes 5, 5 of a header tank 4 to be connected therewith.

Numeral 6 designates a side plate having a U-shaped cross-section and arranged at the upper end and the lower end of the stacked flat tube 2, and numeral 7 designates a blank cap provided at the upper opening and the lower opening of the header tank 4.

A partition plate 8 is arranged at the required place in each header tank 4, and a heat exchanger medium flows in a zigzag form by making a plurality of turns between an inlet joint 9 and an outlet Joint 10 of the header tank 4.

Figure 2:
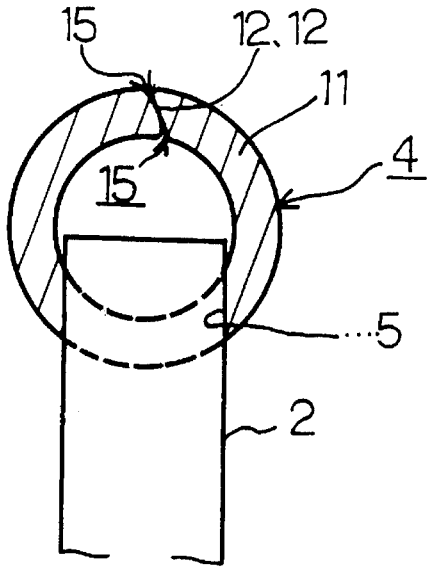
FIG. 2 is a cross-sectional view of the header tank.

As shown in FIG. 2, the header tank 4 is formed by rounding a sheet of header tank material and connecting the ends thereof to make It in a circular tube form.

Figure 3:
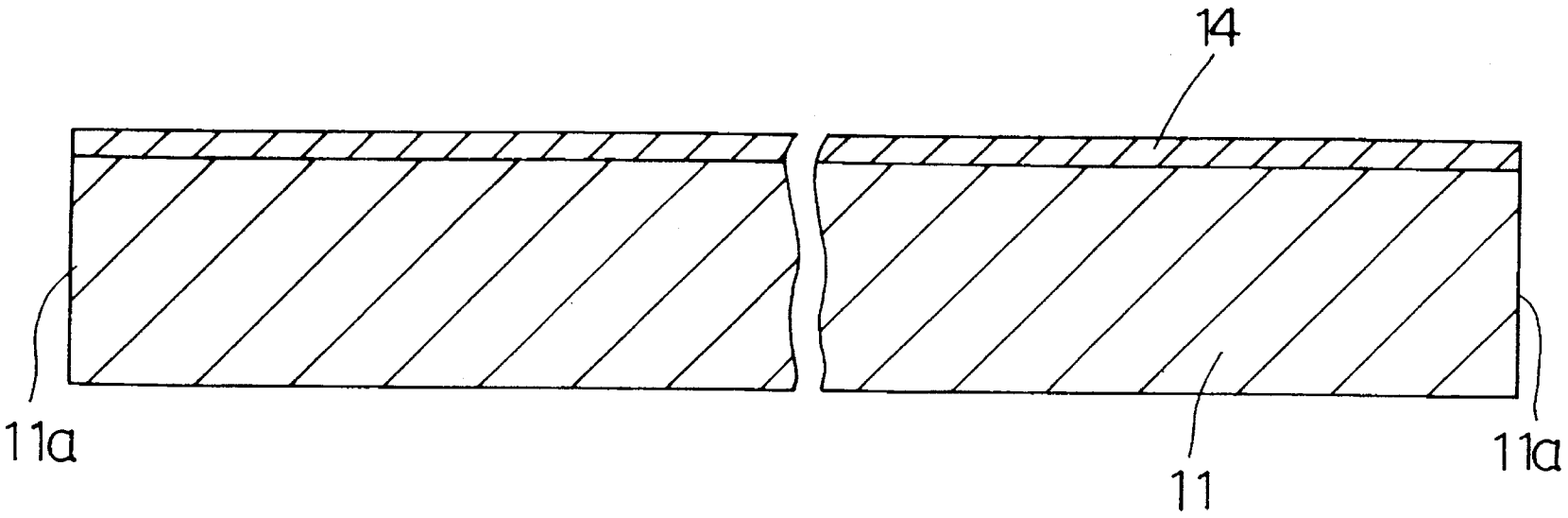
FIG. 3 is a cross-sectional view of the connecting portion of header tank.

With this embodiment, the material of the header tank 4 is a clad material 11 having one of the surfaces coated with a brazing material 14, as shown in FIG. 3. Numeral 11a designates the surface of end edge of the clad material 11.

Figure 4:
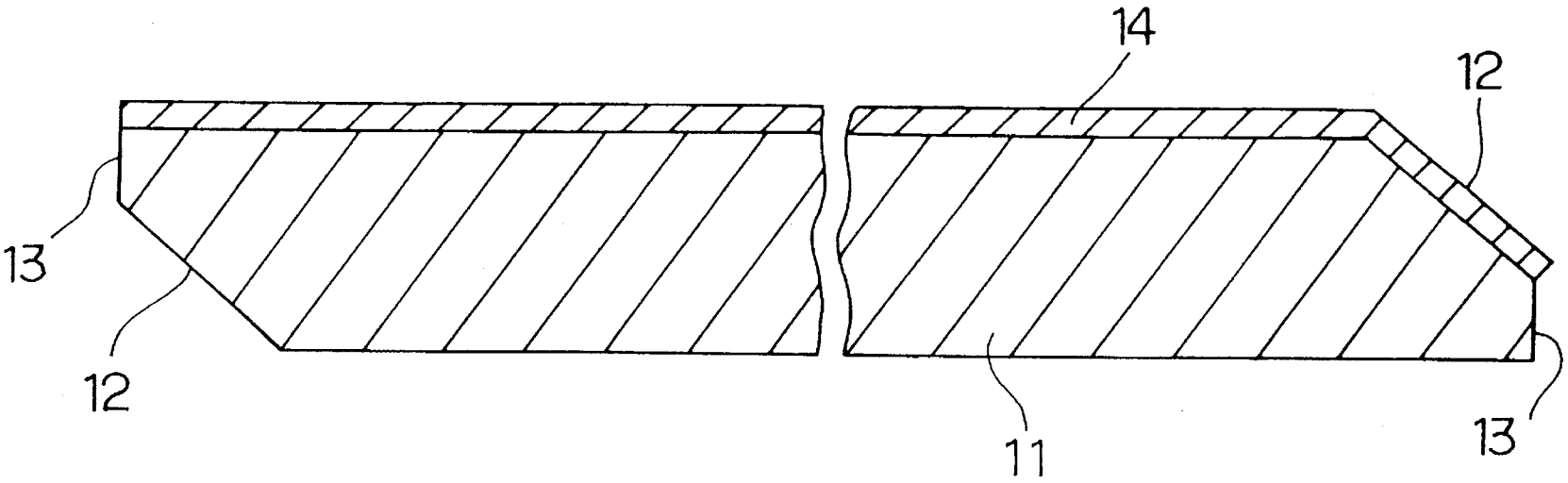
FIG. 4 is a cross-sectional view of the end of header tank, showing an embodiment of the present invention.

The ends of the clad material 11 are, before the material is being rounded, formed with inclined surfaces 12, 12 each with a portion of end edge surface 13 being left there as shown in FIG. 4. The inclined surface 12 of one end is gradually thinned from the outer surface towards the inner surface with respect to the direction of wall thickness (this inclined surface 12 is being coated with the brazing material 14), and the inclined surface 12 of the other end is gradually thinned from the inner surface towards the outer surface with respect to the direction of wall thickness (this inclined surface 12 is not coated with the brazing material 14).

Figure 12:
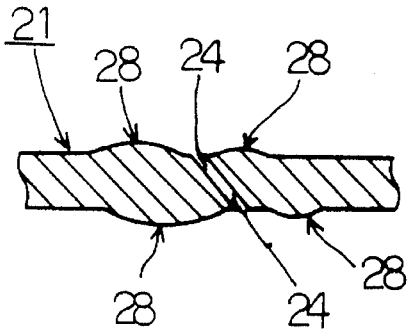
FIG. 12 PRIOR ART
FIG. 12 is a cross-sectional view showing swollen portions formed near the connecting portion of header tank of prior art.

The inclined surface 12 is formed by press forming and the like, and the portion of end edge surface 13 is left there as described above. In the prior art where the inclined surface is formed without having the portion of end edge surface 13 being left, the portion of the material which has been crushed during pressing process tends to escape into other portions of the material so that the swollen portions 28 as shown in FIG. 12 are formed, or the inclined butting surfaces have a phenomenon of waves appeared thereon. However, with the portion of end edge surface 13 being left there, the material which has been crushed during press forming and tending to escape into other portions is reduced, thereby, deformation of the ends which might be caused during press forming is reduced to as little as possible. Needless to say, with this embodiment, if such deformation is caused during press forming, the deformation appears at the end edge surface 13, and if the deformation is great, the deformed portion can be simply chopped off. On the other hand, with the prior art invention, chopping of the swollen portions is not so simple as expected and it involves troublesome work.

A preferred dimension of the portion of the end edge surface 13 to be left is within ½ of wall thickness of the clad material 11 from the standpoint of positioning the two inclined surfaces 12, 12 for butting with each other.

Figure 5:
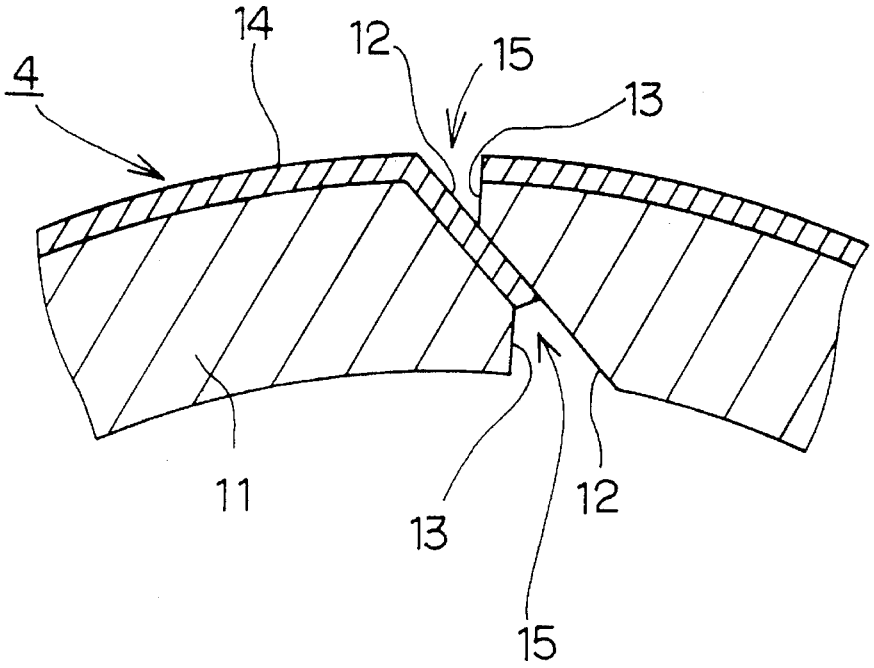
FIG. 5 is a cross-sectional view of the connecting portion of header tank, showing an embodiment of the present invention.

The inclined surfaces 12, 12 are brought into pressure contact with each other as shown in FIG. 5 when the clad material 11 of FIG. 4 is rounded and the ends thereof are connected together. Since the portion of end edge surface 13 is being left at each end as described above, a V-shaped recess 15 is formed respectively at the outer surface and the inner surface of the header tank, by the portion of the end edge surface 13 being left at the side and the inclined surface 12. With the presence of this V-shaped recess 15, the brazing material is pulled into the recess thereby to assure the quality of brazing the connecting surfaces of the ends and provide a good brazing effect.

Now another preferred embodiments of the present invention will be described below successively.

Figure 6:
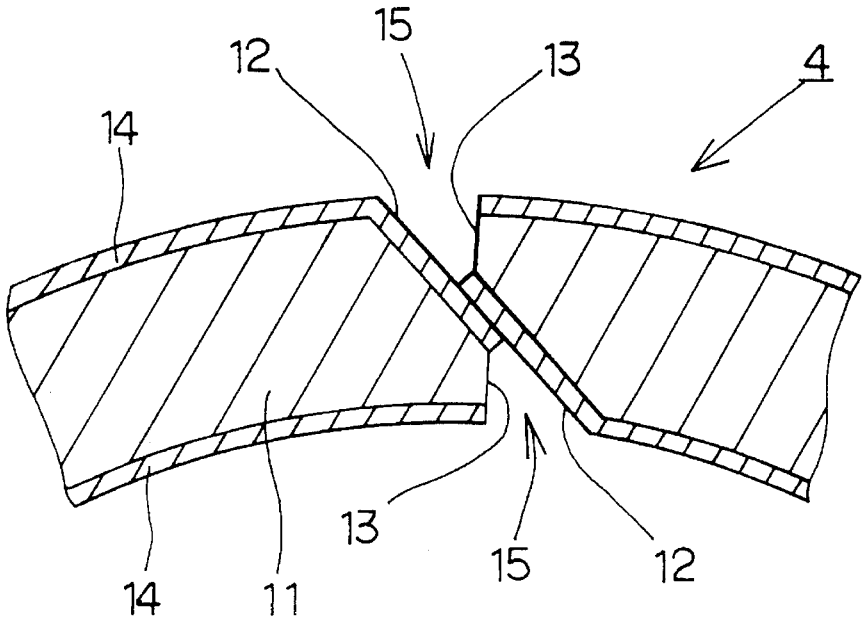
FIG. 6 is a cross-sectional view of the connection portion of header tank, showing another embodiment of the present invention.

Referring to FIG. 6, an embodiment shown uses, for the header tank material of the header tank 4, the clad material 11 having both surfaces coated with the brazing material 14 for the header tank material of the header tank 4. Similar to the above-described embodiment, the inclined surfaces 12, 12 are formed to be inclined with respect to the direction of wall thickness, each with the portion of end edge surface 13 being left there.

The inclined surfaces 12, 12 are so formed that the inclined surface 12 coated with the brazing material 14 of one end is gradually thinned from the outer surface towards the inner surface with respect to the direction of wall thickness with the portion of end edge surface being left, and the inclined surface 12 coated with the brazing material 14 of the other end is gradually thinned from the inner surface towards the outer surface with respect to the direction of wall thickness with the portion of end edge surface being left. When the clad material 11 is rounded and the ends are butted to each other, the inclined surfaces 12, 12, both of which are coated with the brazing material 14, are brought into pressure contact with each other.

Consequently, with the embodiment of FIG. 6, the recess 15 is formed in the outer surface and the inner surface of the header tank, respectively, by the portion of the side end edge surface 13 left there and the inclined surface 12.

Thus, in this embodiment,too, with the presence of the V-shaped recess 15, the brazing material is pulled into the recess during brazing, thereby to assure the quality of brazing of both connecting surfaces and provide a good brazing effect.

Figure 7:
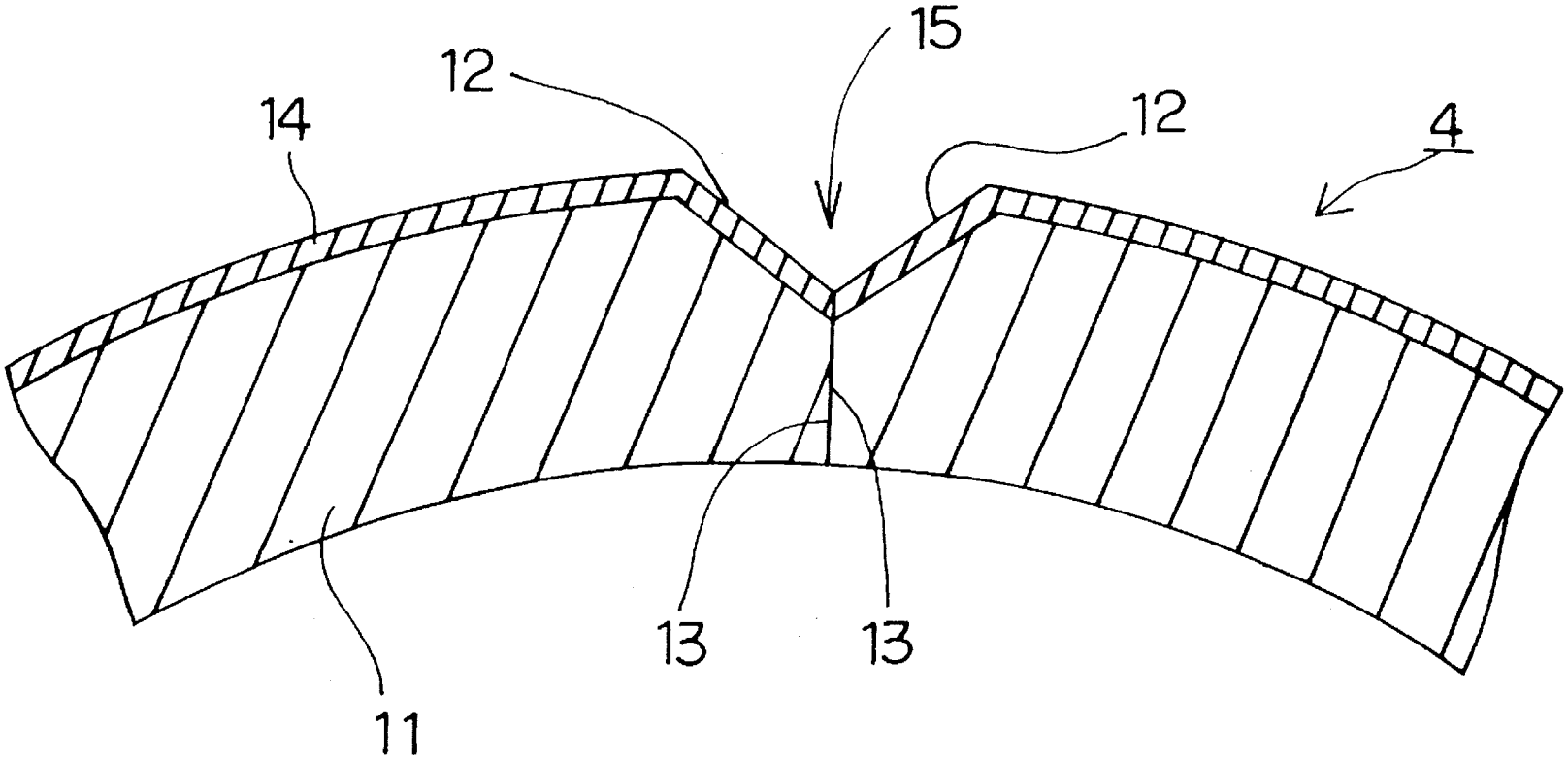
FIG. 7 is a cross-sectional view of the connecting portion of header tank, showing another embodiment of the present invention.

Referring to FIG. 7, an embodiment shown uses, for the header tank material of the header tank 4, the clad material 11 with one of the surfaces being coated with the brazing material 14 for the header tank material of the header tank 4. Similar to the above-described embodiments, inclined surfaces 12, 12 are formed to be inclined with respect to the direction of wall thickness with the portion of end edge surface 13 being left there, respectively.

In this embodiment, both inclined surfaces 12, 12 are gradually thinned from the outer surface towards the inner surface with respect to the direction of wall thickness with the portion of end edge surface being left, respectively, thereby to form the inclined surface 12 coated with the brazing material 14. When the clad material 11 is rounded and the ends are brought into butting with each other, the portions of end edge surfaces 13, 13 being left are brought into pressure contact with each other, and a recess 15 is formed at the outer surface of the header tank by the inclined surfaces 12, 12.

Since the recess 15 of this embodiment is formed by both inclined surfaces 12, 12, it has a greater volume than that of formed by one of the inclined surfaces 12 (for example, the recess 15 shown in FIGS. 5 and 6), view of the fact that the recess having the same or similar volume with that of the above-described embodiments can be obtained by forming the inclined surfaces 12 in relatively short length, this embodiment is best suited for using the header tank material having a thin wall thickness.

Thus, with the embodiment of FIG. 7, the recess 15 is also formed in the outer surface of the header tank by the inclined surfaces 12, 12, and due the presence of the V-shaped recess 15, the brazing material is pulled into the recess during brazing, thereby to assure the quality of brazing of the connecting surfaces and provide a good brazing effect.

Figure 11:
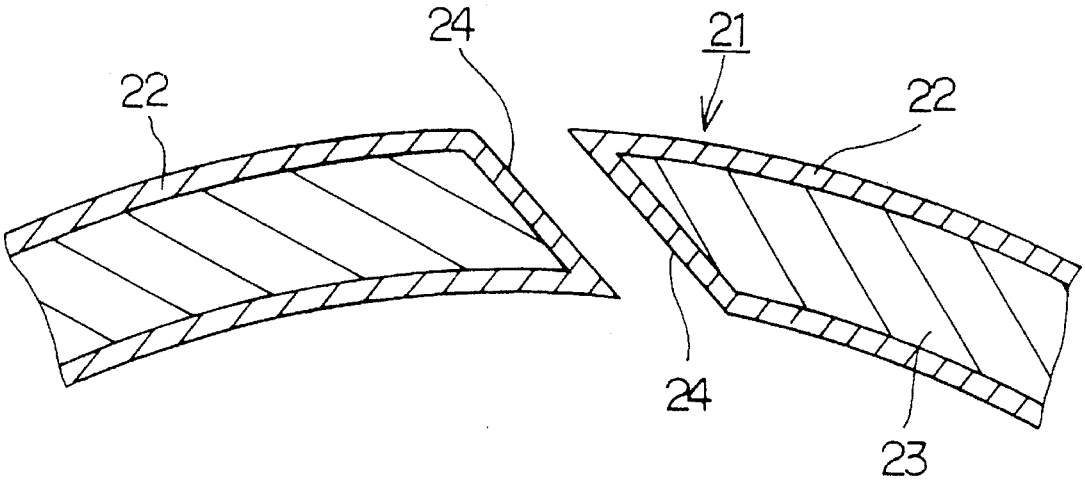
FIG. 11 PRIOR ART
FIG. 11 is a cross-sectional view of the connecting portion of header tank of prior art.

Moreover, with this embodiment, the portions of end edge surfaces 13, are brought into pressure contact with each other, namely, the end edge surfaces 13, 13 which are formed transversely to the direction of wall thickness are brought into pressure contact, thereby to assure the pressure contact of the end edge surfaces 13, As described earlier, with the prior art shown in FIG. 11 the butting surfaces 24, 24 at the ends of the clad material 23 are so formed that the surface of one end is gradually thinned from the outer surface towards the inner surface with respect to the direction of wall thickness, and the surface of the other end is gradually thinned from the inner surface towards the outer surface. Since the forward end of each of butting surfaces 24, 24 is protruding, the clad material 23 should be rounded with the butting surface 24 at the left side in FIG. 11 be at the lower side and the butting surface 24 at the right side in FIG. 11 should be at the upper side, otherwise the forward ends of both butting surfaces are caught. In other words, the left side butting surface 24 should be bent first followed by bending the right side butting surface 24, otherwise the forward ends of both surfaces are caught. Thus, with the prior art of FIG. 11, the ends of the clad material cannot be rounded simultaneously in roll forming of the clad material, but It requires to have time lag for bending the ends.

However, with this embodiment, bending of the ends can be made simultaneously, since the end edge surfaces 13, 13 are formed transversely to the direction of wall thickness. The capability of bending the ends of clad material simultaneously facilitates rounding of the clad material by roll forming.

Figure 8:
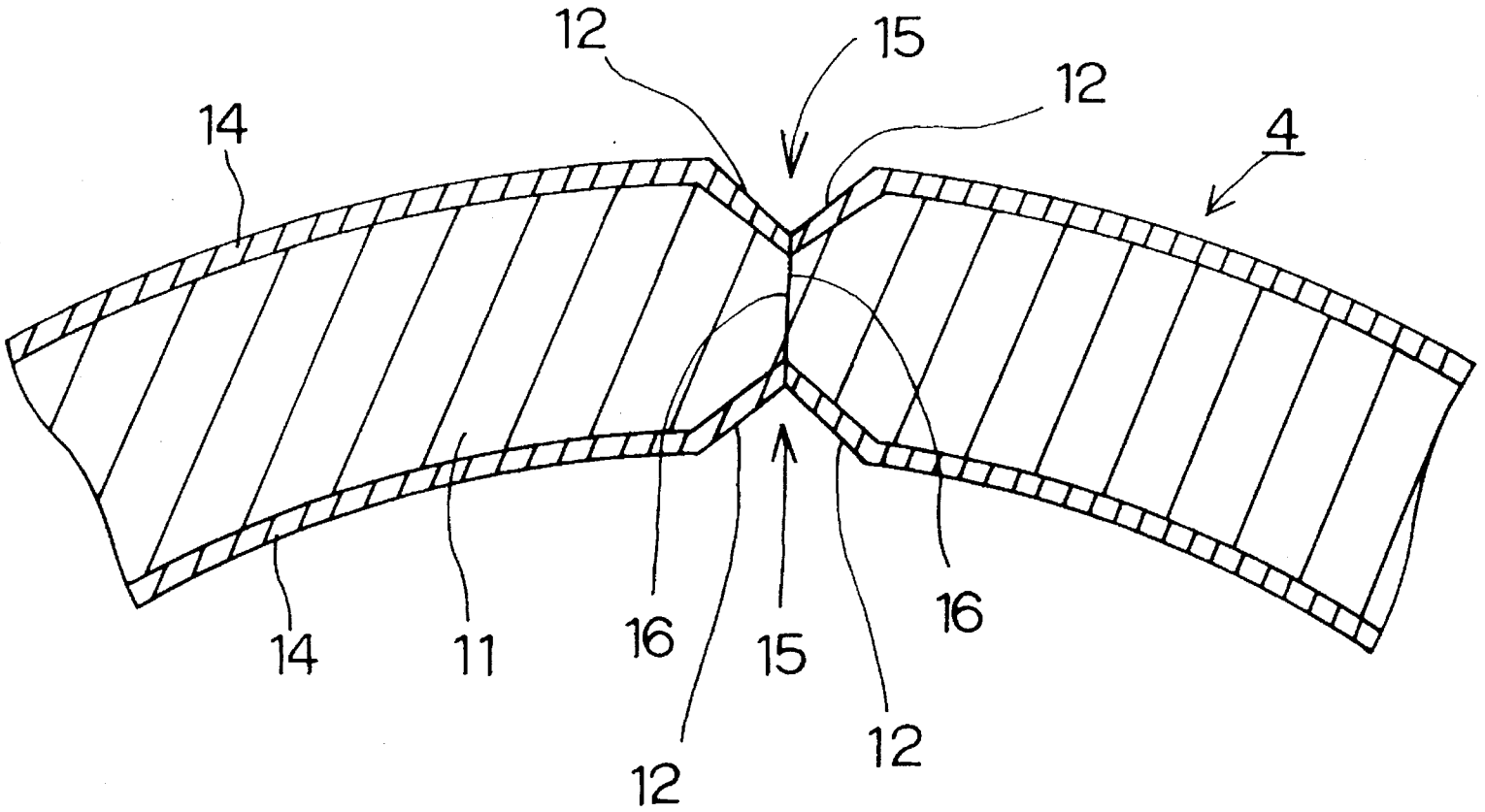
FIG. 8 is a cross-sectional view of the connecting portion of header tank of another embodiment of the present invention.

Referring to FIG. 8, an embodiment shown uses, for the header tank material of the header tank 4, the clad material 11 having both surfaces being coated with the brazing material 14. In this embodiment, the inclined surfaces 12, 12 are so formed that one of them is gradually thinned from the outer surface towards the inner surface with respect to the direction of wall thickness with the center portion of end edge surface 16 being left, and the other surface is gradually thinned in a reverse direction with the center portion of end edge surface 16 being left, so that the center portions of edge surfaces left there interpose between the inclined surfaces 12, 12. Thus, when the clad material 11 is rounded and the ends are butted to each other, the center portions of end edge surfaces 16, 16 being left are brought into pressure contact with each other, and recesses 15, 15 are formed in the outer surface and the inner surface of the header tank respectively by the inclined surfaces 12, 12.

Consequently, with the embodiment of FIG. 8, the recess 15 is formed at both the outer surface and the inner surface of the header tank by the inclined surfaces 12, 12, and due to the presence of the V-shaped recess 15, the brazing material is pulled into the recess during brazing, thereby to assure the quality of brazing of the connecting surfaces and provide a good brazing effect.

Further, with this embodiment, the center portions of end edge surfaces 16, 16 left are brought into pressure contact, namely, the end edge surfaces 16, 16 left at the center are formed transversely to the direction of wall thickness, thereby their pressure contact with each other is made sure. Moreover, the capability of simultaneous bending of the ends facilitates rounding of clad material by roll forming.

Figure 9:
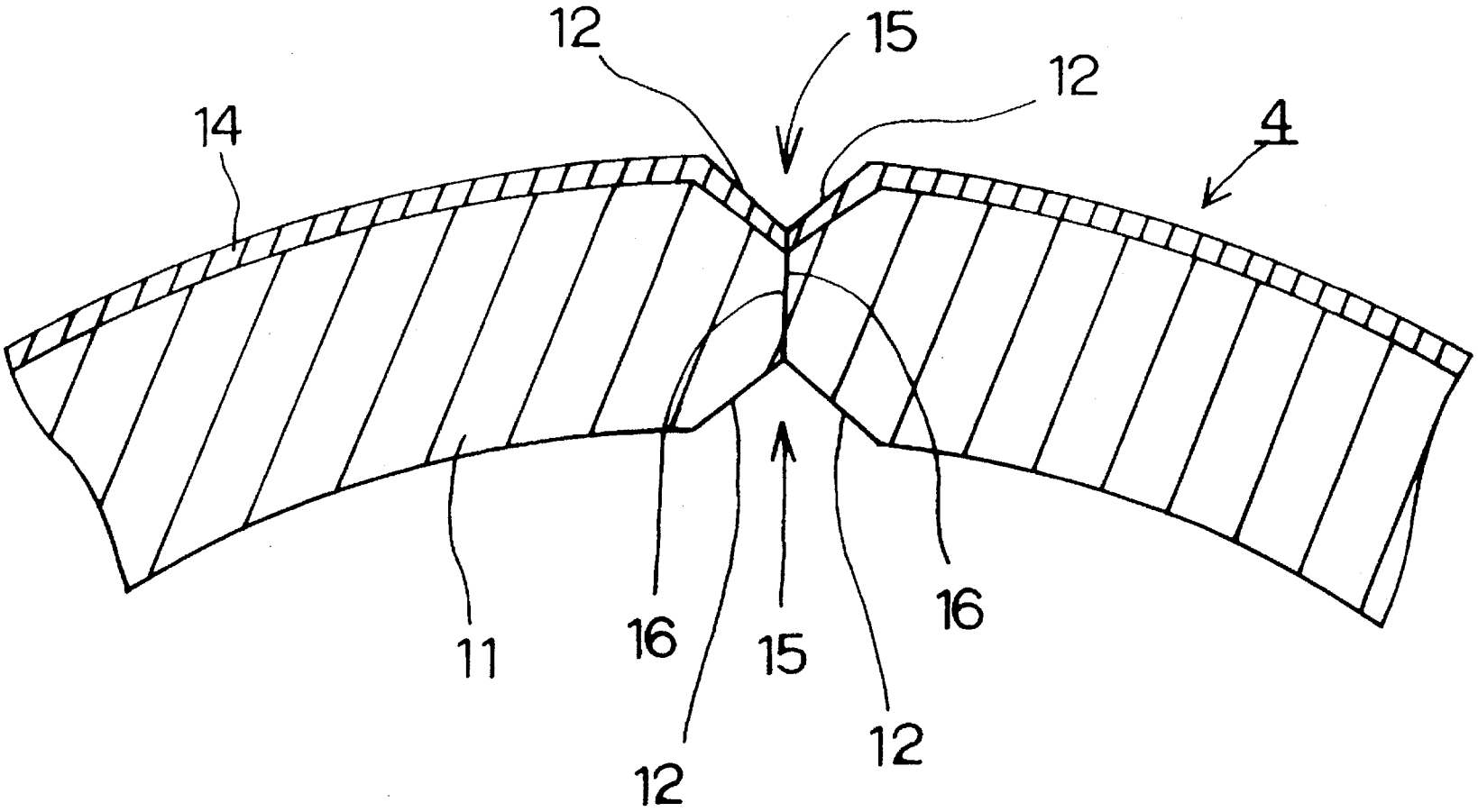
FIG. 9 is a cross-sectional view of the connecting portion of header tank of a further embodiment of the present invention.
Figure 10:
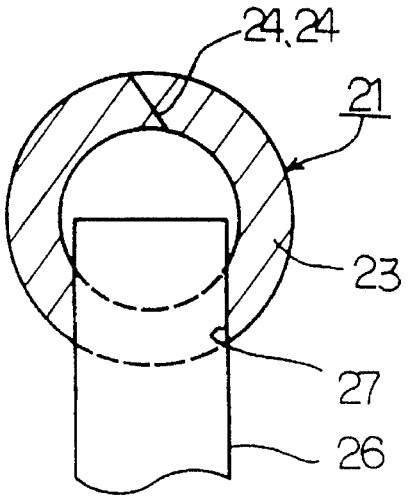
FIG. 10 PRIOR ART
FIG. 10 is a cross-sectional view of header tank of prior art.

Referring to FIG. 9, an embodiment shown uses, for the header tank material of the header tank 4, the clad material 11 having one of the surfaces being coated with the brazing material 14. In this embodiment, the inclined surfaces 12, 12 are so formed that one of them is gradually thinned from the outer surface towards the inner surface with respect to the direction of wall thickness with the center portion of end edge surface 16 being left, and the other surface is gradually thinned in a reverse direction with the center portion of end edge surface 16 being left, so that the center portions of edge surfaces left there interpose between the inclined surfaces 12, 12. Then, when the clad material 11 is rounded and the ends are butted to each other, the center portions of end edge surfaces 16, 16 being left are brought into pressure contact with each other, and recesses 15, 15 are formed in the outer surface and the inner surface of the header tank respectively by the inclined surfaces 12, 12.

Accordingly, with the embodiment of FIG. 9, the recess 15 is forked by the inclined surfaces 12, 12 at least in the outer surface of the header tank, so that, like the embodiment of FIG. 7, due to the presence of the V-shaped recess 15, the brazing material 14 is pulled into the recess during brazing, thereby to assure the quality of brazing of the connecting surfaces and provide a good brazing effect.

Further, like the embodiment of FIG. 8, the center portions of end edge surfaces 16, 16 left are brought into pressure contact also in this embodiment, thereby the pressure contact of end edge surfaces 16, 16 with each other is made sure.

Moreover, bending of the ends can be made simultaneously, like the embodiments of FIGS. 7 and 8, which facilitates rounding of clad material by roll forming.

The above-described preferred embodiments of the present invention have been explained as applied for the parallel type heat exchanger as an example, but It is readily appreciated that the present invention can be also applied for other types of heat exchanger.

What is claimed is:

1. A header tank structure for a heat exchanger, comprising:

a header tank material having opposite ends and major surfaces;

a brazing material coated over at least one of said major surfaces of said header tank material;

said opposite ends provided with inclined end surfaces inclined with respect to a direction of wall thickness and truncated to form perpendicular end surfaces perpendicular with respect to said major surfaces, and said inclined end surfaces being directly extended from said major surface so that when said ends are brought into abutment with each other, at least one recess is formed by said inclined surfaces to pull in a brazing material thereby providing a firm joint between the ends.

2. A header tank structure for a heat exchanger according to claim 1, wherein one of the inclined end surfaces is gradually thinned from an outer surface towards an inner surface and the other inclined end surface is gradually thinned from the inner surface towards the outer surface so that when the inclined end surfaces are brought into pressure contact, recesses are formed in both the outer surface and the inner surface of the header tank by the perpendicular end surfaces and the inclined end surfaces.

3. A header tank structure for a heat exchanger according to claim 1, wherein both of the inclined end surfaces are gradually thinned at least from the outer surface towards the inner surface so that the perpendicular end surfaces are brought into pressure contact when the opposite ends are brought into butting with each other, forming at least one recess in the outer surface of the header tank between the inclined end surfaces.

4. A header tank structure for a heat exchanger according to claim 1, wherein said major surfaces of the header tank material forming outer and inner surfaces of the header tank both are coated with a brazing material.

5. A header tank structure for a heat exchanger according to claim 4, wherein one of the inclined end surfaces is gradually thinned from the outer surface towards the inner surface and the other inclined end surface is gradually thinned from the inner surface towards the outer surface so that when the inclined end surfaces are brought into pressure contact, recesses are formed in both the outer surface and the inner surface of the header tank by the perpendicular end surfaces and the inclined end surfaces.

6. A header tank structure for a heat exchanger according to claim 4, wherein the inclined end surfaces of the ends of the header tank material are provided with an outer surface segment gradually thinned from the outer surface towards the inner surface, a central surface segment perpendicular with respect to said major surfaces, and an inner surface segment gradually thinned from the inner surface toward the outer surface so that the central surface segment is located between the two inclined surfaces segments, so that when the ends are brought into butting with each other, the central surface segments are brought into pressure contact with each other, thereby forming recesses in both the outer surface and the inner surface of the header tank between the inclined end surfaces.

* * * * *